US006497033B1

(12) United States Patent
Agar

(10) Patent No.: US 6,497,033 B1
(45) Date of Patent: Dec. 24, 2002

(54) METHOD OF MAKING A SHELVING STANDARD

(76) Inventor: Robert S. Agar, 150 Ferrier Street, Unit 14, Markham, Ontario (CA), L3R 3K3

( * ) Notice: Subject to any disclaimer, the term of this patent is extended or adjusted under 35 U.S.C. 154(b) by 0 days.

(21) Appl. No.: 09/510,008

(22) Filed: Feb. 22, 2000

(51) Int. Cl.[7] ..... F21V 21/00
(52) U.S. Cl. ..... 29/505; 72/181; 248/121
(58) Field of Search ..... 29/896.6, 505, 29/558, DIG. 32; 72/178, 181; 248/121, 224.8; 211/192, 191

(56) References Cited

U.S. PATENT DOCUMENTS

| | | | | | |
|---|---|---|---|---|---|
| 2,771,077 | A | * | 11/1956 | Karlsson et al. | 72/181 |
| 3,202,467 | A | * | 8/1965 | Eckstein | 29/896.6 |
| 3,470,598 | A | * | 10/1969 | Berthelsen | 29/896.6 |
| 3,788,490 | A | * | 1/1974 | Featherman | 211/176 |
| 4,158,998 | A | * | 6/1979 | Clement | 211/191 |
| 4,197,952 | A | * | 4/1980 | De Fouw et al. | 211/191 |
| 4,285,436 | A | * | 8/1981 | Konstant et al. | 211/192 |
| 4,406,374 | A | * | 9/1983 | Yedor | 211/192 |
| 4,708,252 | A | * | 11/1987 | Azzi | 211/192 |
| 5,004,201 | A | | 4/1991 | Bessinger | 248/243 |
| 5,069,408 | A | | 12/1991 | Bessinger | 248/250 |
| 5,377,851 | A | * | 1/1995 | Asano et al. | 211/191 |
| 5,970,769 | A | * | 10/1999 | Lipari | 72/181 |
| 5,983,691 | A | * | 11/1999 | Voth et al. | 72/178 |

FOREIGN PATENT DOCUMENTS

| | | |
|---|---|---|
| CA | 2120405 | 10/1995 |

* cited by examiner

*Primary Examiner*—David P. Bryant
*Assistant Examiner*—Jermie E. Cozart
(74) *Attorney, Agent, or Firm*—Ronald D. Faggetter; Mark R. Wisner

(57) ABSTRACT

A shelving standard is fabricated from a single plate with portions of the plate folded back on themselves, preferably utilizing roll forming operations. This allows bores formed in the plate before roll forming to be aligned in pairs as through holes when portions of the plate are folded over on themselves. By forming one bore of a pair larger than another, the bore pair becomes a countersunk hole. Such a shelving standard may be screwed to a stud which has a gap therein so that a line of slots in the standard is aligned with the gap. The stud also has a transverse through hole supporting a cross-member. Wall panels are provided with clips which rest on the cross-member so that wall panels may be mounted without being screwed to the stud.

7 Claims, 5 Drawing Sheets

METHOD OF MAKING A SHELVING STANDARD

FIELD OF THE INVENTION

This invention relates to a shelving standard, to a method of making a shelving standard and to a shelving system.

BACKGROUND OF THE INVENTION

Shelving assemblies are commonly used in a retail environment. An assembly typically comprises a pair of side-by-side vertically disposed slotted shelving standards with cantilever brackets hooked into the slots and shelves resting on pairs of brackets. The assembly is secured to a wall with screws which extend through bores in the standards.

Shelving standards are currently typically formed from three metal pieces: a rectangular plate with a medial line of slots stamped therein, and two L-shaped pieces spot welded to the plate on either side of the line of slots so as to result in a "Π"-shaped profile. After welding, bores are drilled through the standard where the L-shaped pieces join to the plate to provide screw holes to affix the standard to a wall. Often the bores are countersunk. Such a standard is of relatively expensive manufacture.

With a shelving standard having a "Π"-shaped profile, it is necessary to provide a gap in the wall behind the standard to accommodate the hooks of the brackets which extend through the slots of the standard. Additionally, to ensure a secure mount to a wall, it is preferable to screw a standard into a wall stud. To meet these criteria, in setting up a wall for supporting a shelving assembly, pairs of studs are erected with a small gap between them. Next, a shelving standard is screwed into a pair of adjacent studs such that the medial line of slots overlies the gap between the pair of studs. Now wall panels may be screwed to the studs such that a side edge of a wall panel abuts a depending leg of one of the L-shaped pieces of the shelving standard. Lastly, brackets may be hooked into slots in the shelving standard and shelves erected between brackets of adjacent shelving standards. Such a shelving standard system is relatively costly.

This invention seeks to overcome drawbacks of known methods of forming shelving standards and of known shelving standard systems.

SUMMARY OF THE INVENTION

The present invention fabricates a shelving standard from a single plate with portions of the plate folded back on themselves, preferably utilizing roll forming operations. This allows bores formed in the plate before roll forming to be aligned in pairs as through holes when portions of the plate are folded over on themselves. By forming one bore of a pair larger than another, the bore pair becomes a countersunk hole. Such a shelving standard may be screwed to a stud which has a gap therein so that a line of slots in the standard is aligned with the gap. The stud also has a transverse through hole supporting a cross-member. Wall panels are provided with clips which rest on the cross-member so that wall panels may be mounted without being screwed to the stud.

Accordingly, the present invention provides a method of making a shelving standard comprising: forming a medial line of longitudinal slots in a metal plate; roll forming said metal plate to fold said metal plate into a configuration suitable for use as a shelving standard.

According to another aspect of the invention, there is provided a shelving standard comprising: a web bent from a single plate so as to have a profile with a "Π" shape, said "Π" shape having a pair of legs and a pair of wings, each wing having a lower layer from which one of said legs depend and an upper layer overlying said lower layer; a plurality of slots in said web between said pair of legs; a plurality of bores in said upper layer of said each wing and a plurality of bores in said lower layer of said each wing, said bores in said upper layer aligned with said bores in said lower layer so as to form through holes in said each wing.

According to a further aspect of the invention, there is provided a shelving system, comprising: a wall stud having a wall with a gap or indentation; a shelving standard having a "Π"-shaped profile with a base and a pair of depending legs and a line of slots extending along said base between said legs; said base of said standard joined to said stud across said gap or indentation of said stud such that said slots are aligned with said gap or indentation.

BRIEF DESCRIPTION OF THE DRAWINGS

In the figures which illustrate the invention.

DETAILED DESCRIPTION OF THE PREFERRED EMBODIMENTS

Figure 1:
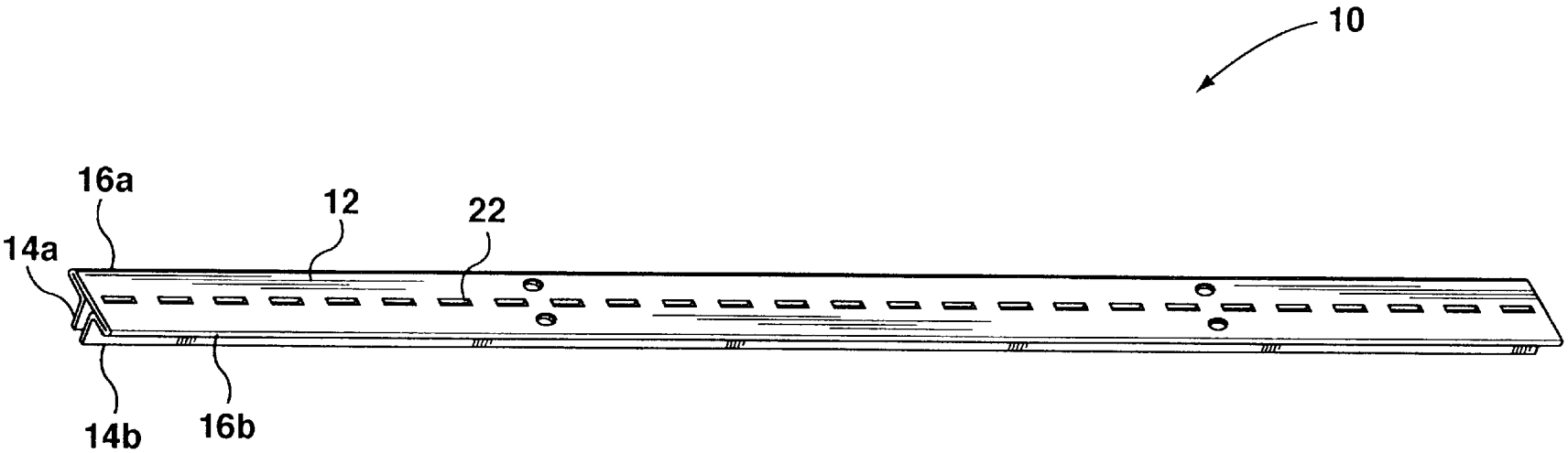
FIG. 1 is a perspective view of a shelving standard made in accordance with this invention.
Figure 2:
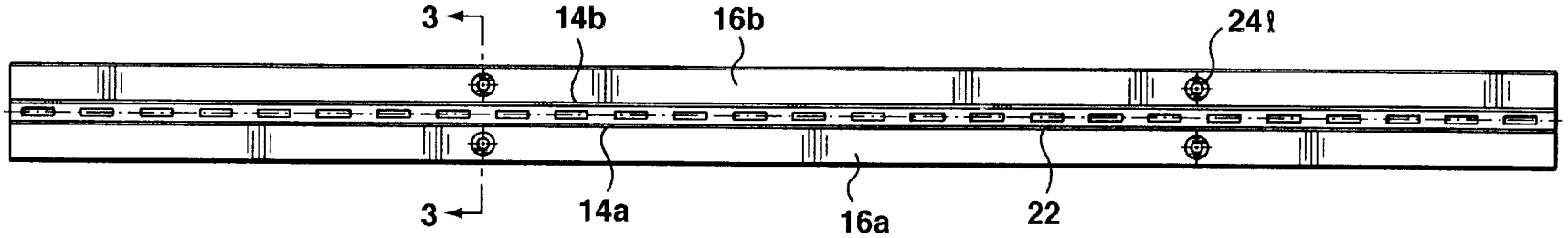
FIG. 2 is a bottom view of FIG. 1.
Figure 3:
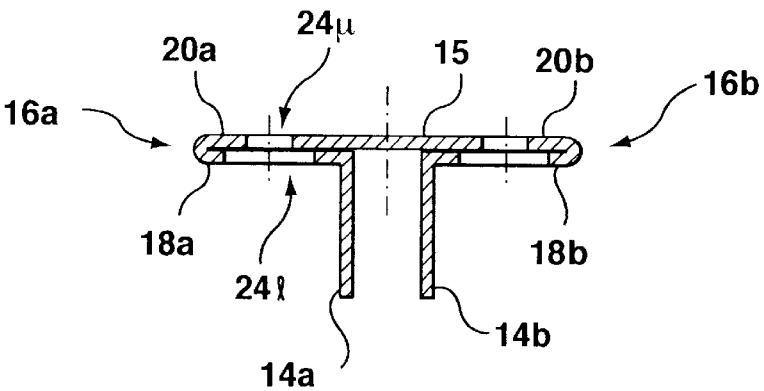
FIG. 3 is a cross-sectional view along the lines 3—3 of FIG. 2.

Referencing FIGS. 1 to 3, a shelving standard 10 comprises a web 12 formed from a metal plate with a profile generally shaped as the capital Greek letter "Π". The web has a pair of legs 14*a*, 14*b* depending from a base 15 having a pair of wings 16*a*, 16*b*. Each wing 16*a*, 16*b* has a lower layer 18*a*, 18*b* from which a leg 14*a*, 14*b* depends and an upper layer 20*a*, 20*b* overlying the lower layer. A line of longitudinally elongated slots 22 extend in the base of the web between the legs 14*a*, 14*b*.

Each of the upper 20*a*, 20*b* and lower 18*a*, 18*b* layers of wings 16a, 16*b* have bores 24*u* and 241, respectively. The bores 241 in the lower layer 18*a*, 18*b* of the wings have a larger diameter than the bores 24*u* in the upper layer 20*a*, 20*b* of the wings. Also, each bore 24*u* in the upper layer 20*a*, 20*b* of a wing is aligned with a bore 241 in the lower layer 18*a*, 18*b* of a wing so as to form through holes in each wing. It will be apparent that these through holes are countersunk holes due to bores 241 having a larger diameter than the bores 24*u*.

As will be apparent to those skilled in the art, the slots 22 of shelving standard 10 are adapted to receive the hooks of cantilever brackets such that a shelving assembly may be made from shelving standards 10 with such brackets and suitable shelves. Optionally, the shelving standard may also be used with cantilever trees which hook to the standard and provide structure (typically knobs) to support wares (such as hangars carrying clothing).

Figure 4:
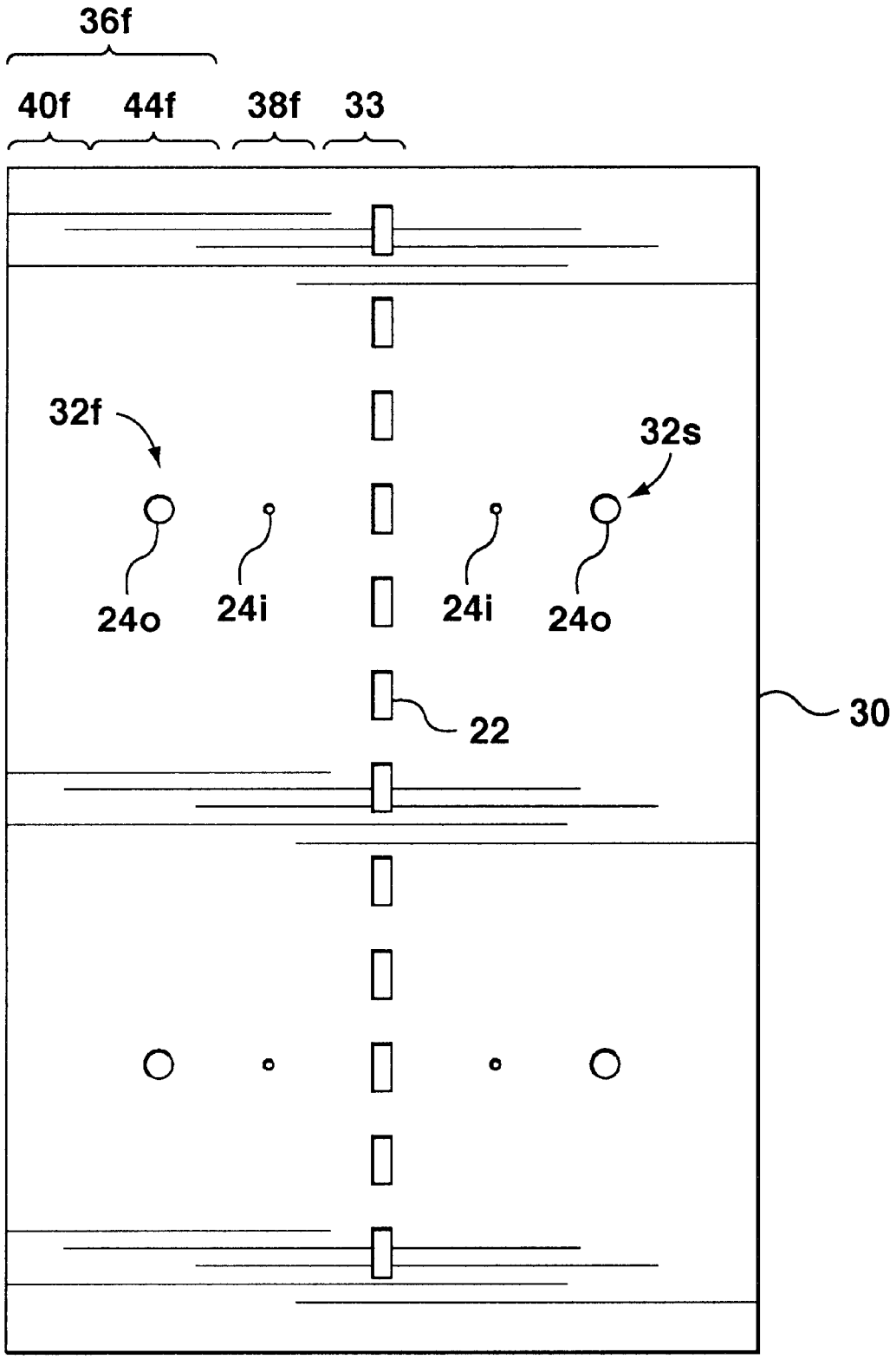
FIG. 4 is a front view of a plate from which the shelving standard of FIG. 1 is formed.
Figure 5:
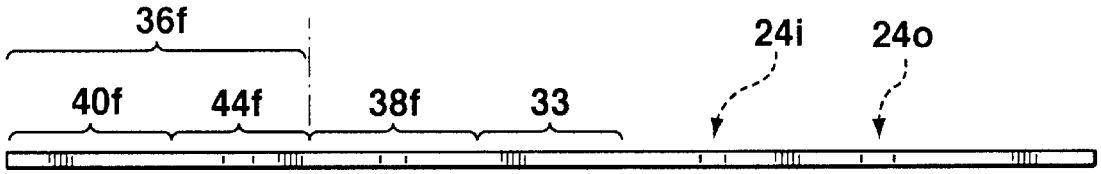
FIG. 5 is a side view of FIG. 4.

Shelving standard 10 may be formed from the metal plate illustrated in FIG. 4. Turning to FIGS. 4 and 5, a plain metal plate 30 may be provided with a medial line of slots 22 in a medial portion 33 of the plate by stamping or in any other convenient manner. At the same time, or in a subsequent operation, a plurality of first 32*f* and second 32*s* pairs of bores 24*i*, 24*o* may be formed in plate 30, again by stamping, drilling, or in any other convenient manner. The outer bore 24*o* of each pair 32*f*, 32*s* of bores lies in a marginal portion 36*f*, 36*s* of the plate and the inner bore 241 of each pair of bores lies in an intermediate portion 38*f*, 38*s* of the plate. The intermediate portion 38*f*, 38*s* of the plate extends between the marginal portion 36*f*, 36*s* and the medial portion 33 of the plate. The outer bore 24*o* of each bore pair 32*f*, 32*s* has a larger diameter than the inner bore 24*i* of the pair.

Figure 6:
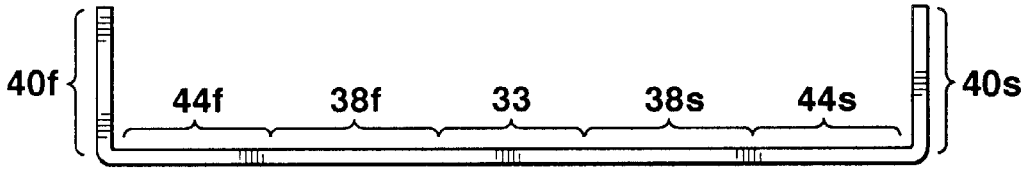
FIG. 6 is a side view of a plate partially folded into the shelving standard of FIG. 1.
Figure 7:
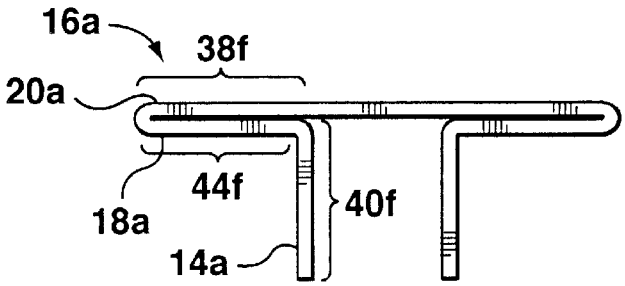
FIG. 7 is a side view of the shelving standard of FIG. 1.

To form shelving standard 10 (FIG. 1) from plate 30, an outer strip 40*f*, 40*s* of each marginal portion 36*f*, 36*s* of the plate is first bent forwardly to make a right angle with the rest of the plate, as illustrated schematically in FIG. 6. This bending may be accomplished with a series of roll forming operations. Next, each marginal portion 36*f*, 36*s* is bent backwardly, preferably by roll forming, so that an inner strip 44*f*, 44*s* of each marginal portion 36*f*, 36*s* underlies intermediate portion 28*f*, 38*s*, as illustrated in FIG. 7. In the result, the outer strips 40*f*, 40*s*, have become legs 14*a*, 14*b*; the inner strips 44*f*, 44*s* have become the lower layers 18*a*, 18*b* of wings 16*a*, 16*b*; and the intermediate portions 38*f*, 38*s* have become the upper layers 20*a*, 20*b* of wings 16*a*, 16*b*. Additionally, bores 24*i* have become bores 241 and bores 24*o* have become bores 24*u*.

Figure 8:
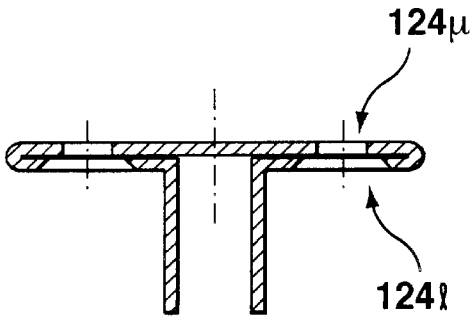
FIG. 8 is a cross-section view of a shelving standard made in accordance with another embodiment of this invention.

FIG. 8 illustrates a modification wherein the lower bores 1241 have a truncated conical shape with at least the base of the conical shape having a larger diameter than the diameter of the upper bores 124*u*.

Figure 9:
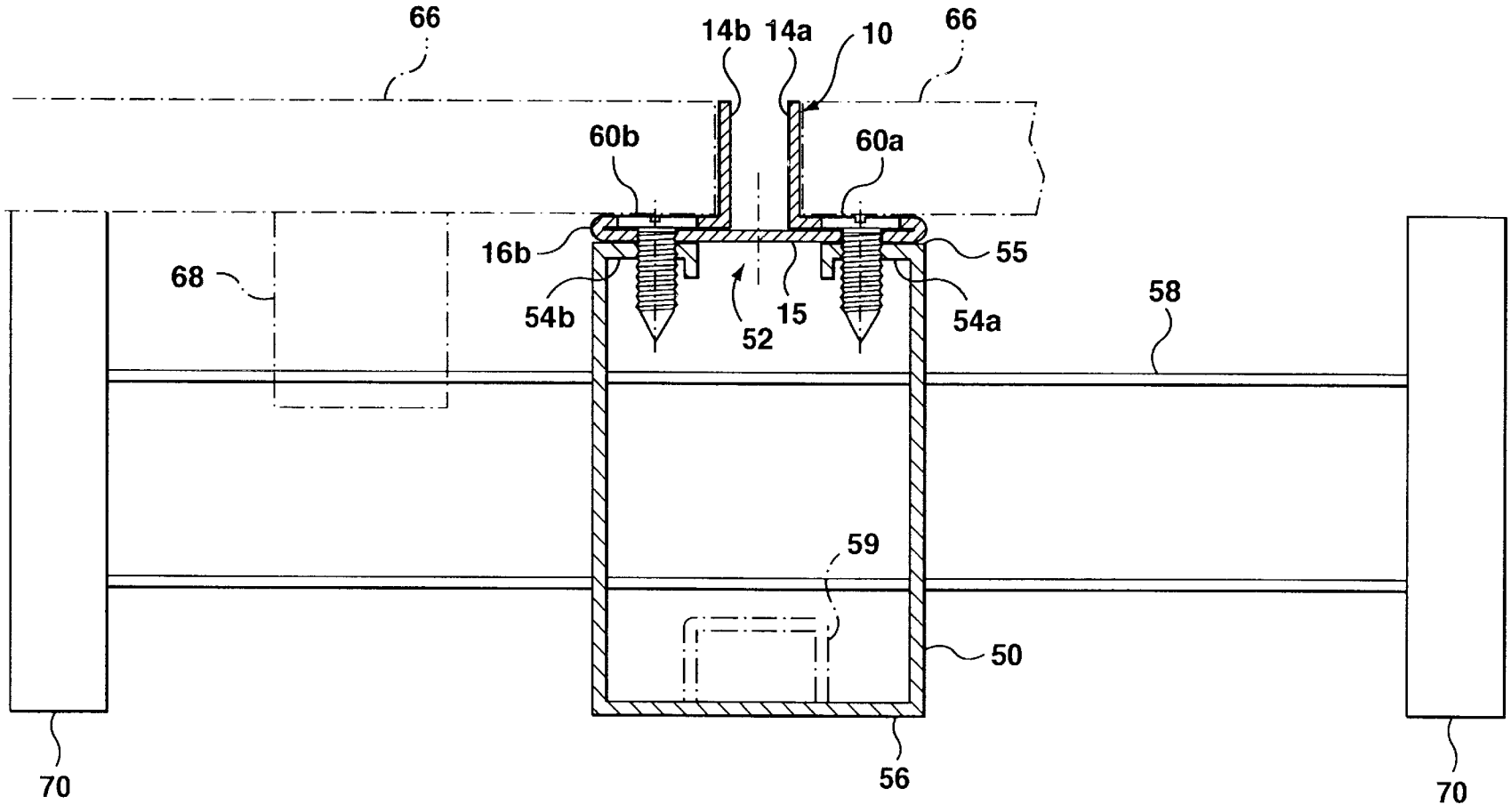
FIG. 9 is a cross-sectional view of a shelving system utilizing the shelving standard of FIG. 1.

In use, turning to FIG. 9, one or more C-shaped wall studs 50 may be erected in a wall frame structure. The studs 50 are oriented such that the gap 52 between legs 54*a*, 54*b* of the stud faces outwardly. A cross-bar 58 may be inserted through transversely aligned openings (not shown) in a stud 50. Also, the base 15 of a shelving standard 10 may be placed against legs 54*a*, 54*b* and screws may be received in the through holes in the standard provided by bore pairs 241, 24*u* (FIG. 3) and screwed into the legs 54*a*, 54*b* of the stud 50. In this regard, the larger diameter of bore 241 allows the screw head to be countersunk. A wall panel 66 provided with a clip 68 may then be clipped to nross-bar 5*n* either side of legs 14*a*, 14*b* of the standard such that the edge of each wall panel abuts a leg 14*a*, 14*b* of the standard. Abutments 70 at the ends of cross-bar 58 help to support the wall panels. Next, the hooks of cantilever brackets or cantilever trees may be inserted in the elongated slots 22 (FIG. 2) in the standard with the gap 52 in the wall 55 of stud 50 permitting full insertion. In the case of cantilever brackets, shelves may be supported on such brackets of two side-by-side standards.

Optionally, the C-shaped stud may be modified so that a wall 56 of the stud opposite wall 55 has an indentation shown in phantom at 59. With this modification, a shelving standard 10 may be screwed to wall 56 so tat legs 14*a*, 14*b*, of the standard are aligned with the indentation 59. The indentation then accommodates full insertion of cantilever brackets or cantilever trees in the elongate slots 22 of the standard. Thus, with the modified stud, a standard 10 may be attached at either one of the two opposite walls 55, 56 of the stud.

A suitable wall board clip and cross-bar system is more fully described in Canadian patent application no. 2,120,405 filed Mar. 31, 1994, the contents of which are incorporated herein by reference.

Other modifications will be apparent to those skilled in the art and, therefore, the invention is defined in the claims.

What is claimed is:

1. A method of making a shelving standard, comprising:

providing a metal plate;

forming a plurality of slots in a medial portion of said plate for receiving cantilever bracket hooks;

forming a plurality of first pairs of bores in said plate, one of each first pair lying in a first marginal portion of said plate and another of each first pair lying in a first intermediate portion of said plate, said first intermediate portion extending between said medial portion and said first marginal portion;

forming a plurality of second pairs of bores in said plate, one of each second pair lying in a second marginal portion of said plate, said second marginal portion opposite said first marginal portion, and another of each second pair lying in a second intermediate portion of said plate, said second intermediate portion extending between said medial portion and said second marginal portion;

performing a series of roll forming operations to fold said first marginal portion of said plate over said first intermediate portion of said plate and said second marginal portion of said plate over said second intermediate portion of said plate such that bores of each pair of bores are aligned to provide a through hole.

2. The method of claim 1 wherein each bore forming step forms a given pair of bores so that one bore of said given pair of bores is larger than another bore of said given pair of bores.

3. The method of claim 1 wherein said forming a plurality of first pairs of bores forms a given pair of bores so that a bore of said given pair in said first marginal portion of said plate is larger than a bore of said given pair in said first intermediate portion of said plate.

4. The method of claim 3 wherein said forming a plurality of first pairs of bores forms said bore of said given pair in said first marginal portion of said plane so as to have a truncated cone shape.

5. The method of claim 1 wherein said slots are formed by stamping and said bores are formed by one of stamping and drilling.

6. The method of claim 1 wherein said performing a series of roll forming operations includes performing a second series of roll forming operations and further comprising:

prior to performing said second series of roll forming operations, performing a first series of roll forming operations to fold an outer strip of said first marginal portion forwardly to make a right angle with a remainder of said first marginal portion and an outer strip of said second marginal portion forwardly to make a right angle with a remainder of said second marginal portion; and wherein said second series of roll forming operations folds said marginal portions backwardly.

7. A method of making a shelving standard, comprising:

providing a metal plate;

forming a plurality of slots in a medial portion of said plate for receiving cantilever bracket hooks;

performing a first series of roll forming operations to fold an outer strip of a first marginal portion of said plate at a right angle to a remainder of said first marginal portion and an outer strip of a second marginal portion of said plate at a right angle to a remainder of said second marginal portion, said second marginal portion being opposite said first marginal portion;

performing a second series of roll forming operations to fold said first marginal portion of said plate over a first intermediate portion of said plate which extends between said first marginal portion and said medial portion, and said second marginal portion of said plate over a second intermediate portion of said plate which extends between said second marginal portion and said medial portion, so that said first marginal portion outer strip and said second marginal portion outer strip are opposed on either side of said slots.

* * * * *